US005350174A

United States Patent [19]

Ritchie et al.

[11] Patent Number: 5,350,174

[45] Date of Patent: Sep. 27, 1994

[54] BELOW THE PLAYFIELD BALL DELIVERY SYSTEM FOR A PINBALL GAME

[75] Inventors: Steve Ritchie, Evanston; Carl Biagi, Chicago, both of Ill.

[73] Assignee: Williams Electronics Games, Inc., Chicago, Ill.

[21] Appl. No.: 144,306

[22] Filed: Oct. 28, 1993

[51] Int. Cl.[5] ..... A63F 9/36

[52] U.S. Cl. ..... 273/121 A; 273/120 A; 273/123 R; 273/123 A; 273/129 S; 273/129 V

[58] Field of Search ..... 273/118–125, 273/129 R, 129 S, 129 V, 129 W

[56] References Cited

U.S. PATENT DOCUMENTS

| | | | |
|---|---|---|---|
| 2,024,851 | 12/1935 | Frohne | 273/121 A |
| 2,051,229 | 8/1936 | Tigerman | 273/121 A |
| 2,110,902 | 3/1938 | Bailey | 273/121 A |
| 2,112,255 | 3/1938 | Swenson | 273/121 A |

*Primary Examiner*—Theatrice Brown

*Assistant Examiner*—Raleigh W. Chiu

*Attorney, Agent, or Firm*—Rockey, Rifkin and Ryther

[57] ABSTRACT

The ball delivery system of the invention consists of a ramp located beneath the playfield where the ramp leads from an inlet accessible by the ball in play to at least one play feature to be loaded. At least one ball is stored in the ramp at each play feature such that the stored ball can be loaded into the play feature. A sensor located adjacent the inlet detects the entrance of the ball in play into the ramp and sends a signal to the game microprocessor indicating that a ball has entered the ramp. The microprocessor, upon receiving this signal, immediately loads the desired play feature with the stored ball such that the play feature can be immediately activated. The ball that entered the ramp inlet is then directed to the just activated play feature and becomes the stored ball for that play feature. Thus, the dead time associated with existing ball delivery system is eliminated.

20 Claims, 4 Drawing Sheets

FIG. 3
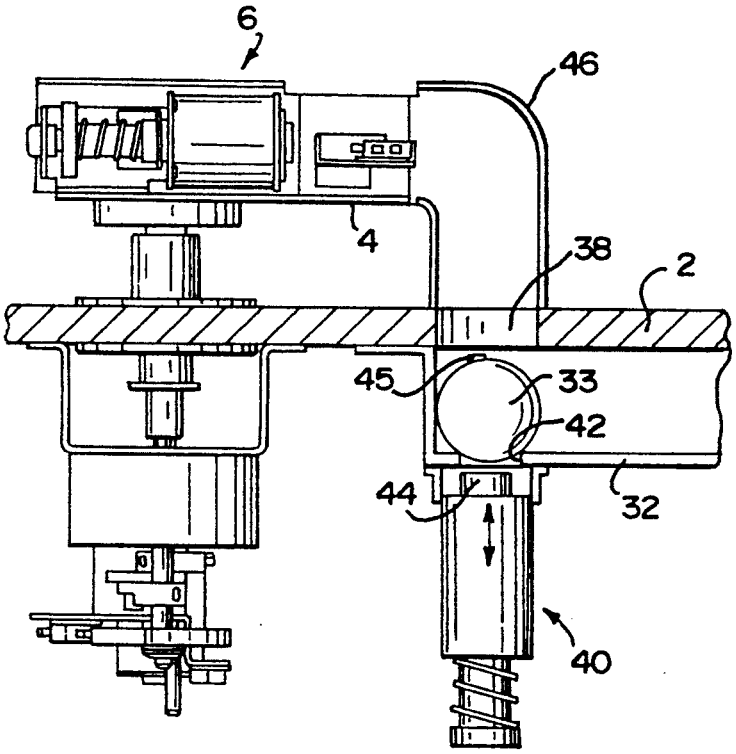
FIG. 4
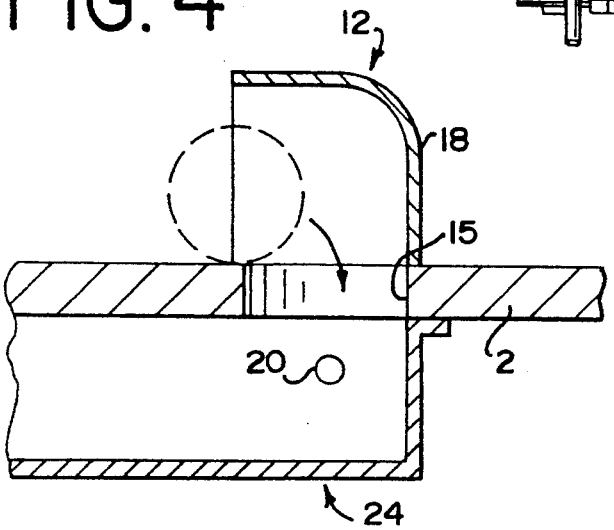
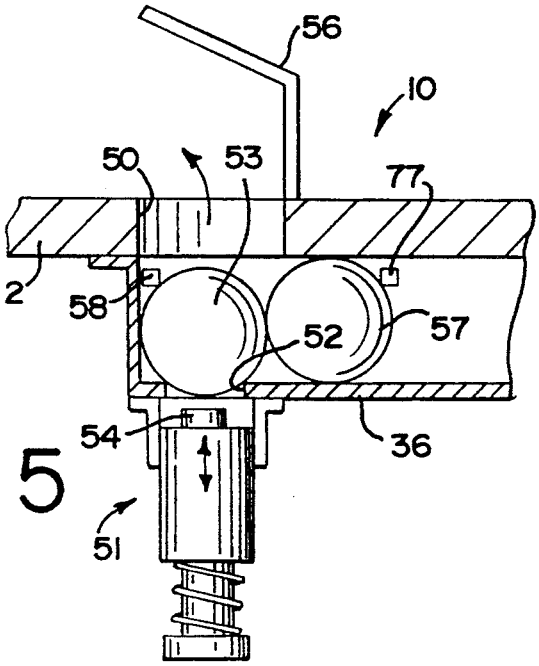
FIG. 5

BELOW THE PLAYFIELD BALL DELIVERY SYSTEM FOR A PINBALL GAME

BACKGROUND OF THE INVENTION

The invention relates, generally, to pinball games and, more particularly, to an improved ball delivery system for such games.

The typical pinball game consists of an inclined playfield supporting a rolling ball, a plurality of play features such as targets, bumpers, ramps and the like, and player operated flippers. The player operates the flippers to direct the ball at selected play features thereby to control play of the game and score points.

Some existing play features require that a ball be loaded into the play feature before the play feature can be operated. An example of such a play feature is shown in U.S. Pat. No. 5,186,462 issued to Biagi et al. and consists of an oscillating ball cannon where the ball is loaded into the cannon when the player shoots the ball onto a ramp. Once loaded, the ball cannon is fired either automatically by the game microprocessor or manually by the game player thereby propelling the ball back onto the playfield.

It will be appreciated that play features other than a ball cannon require that a ball be loaded in the play feature before it can be actuated. For example, eject holes, ball storage devices and the like require the loading of a ball.

In existing pinball games, balls are loaded into this type of play feature in one of two ways. First, the ball can be loaded using a ramp or other device mounted on or above the playfield as shown in Biagi et al. Alternatively, a ball delivery system is located below the playfield, out of the player's view, usually consisting of a ramp or ramps leading from a ball inlet to the play feature to be loaded. The player shoots the ball into the ball inlet and the ball is delivered from the inlet to the desired play feature via the ramp.

Using either of the previously described methods, there is a delay between the time the ball enters the ball inlet and the time it reaches the play feature because the ball must traverse the ramp from the inlet to the play feature. This delay slows play of the game and creates short periods of "dead time" when play of the game is temporarily suspended. This situation is more problematic with the below a playfield systems because the player is not able to visually follow the ball as it traverses the ramp.

Thus, a ball delivery system for a pinball game that does not create "dead time" is desired.

SUMMARY OF THE INVENTION

The ball delivery system of the invention consists of a ramp system located beneath the playfield where the ramps lead from various inlets accessible by the ball in play to at least one play feature to be loaded. At least one ball is stored in the ramp at each play feature such that the stored ball can be loaded into the play feature in place of the current "ball in play". A sensor located adjacent the inlet detects the entrance of the ball in play into the ramp system and sends a signal to the game microprocessor indicating that a ball has entered the ramp. The microprocessor, upon receiving this signal, immediately loads a selected play feature with the stored ball such that the play feature can be immediately activated. The ball that entered the ramp inlet is directed to the just activated play feature and becomes the stored ball for the next operation of that play feature. Thus, the dead time associated with existing ball delivery system is eliminated.

BRIEF DESCRIPTION OF THE DRAWINGS

FIG. 3 is a section view taken along line 3—3 of FIG. 1.

FIG. 4 shows a section view of a ball inlet for the delivery system of the invention.

FIG. 5 is a section view taken along line 5—5 of FIG. 1.

DETAILED DESCRIPTION OF THE INVENTION

Figure 1:
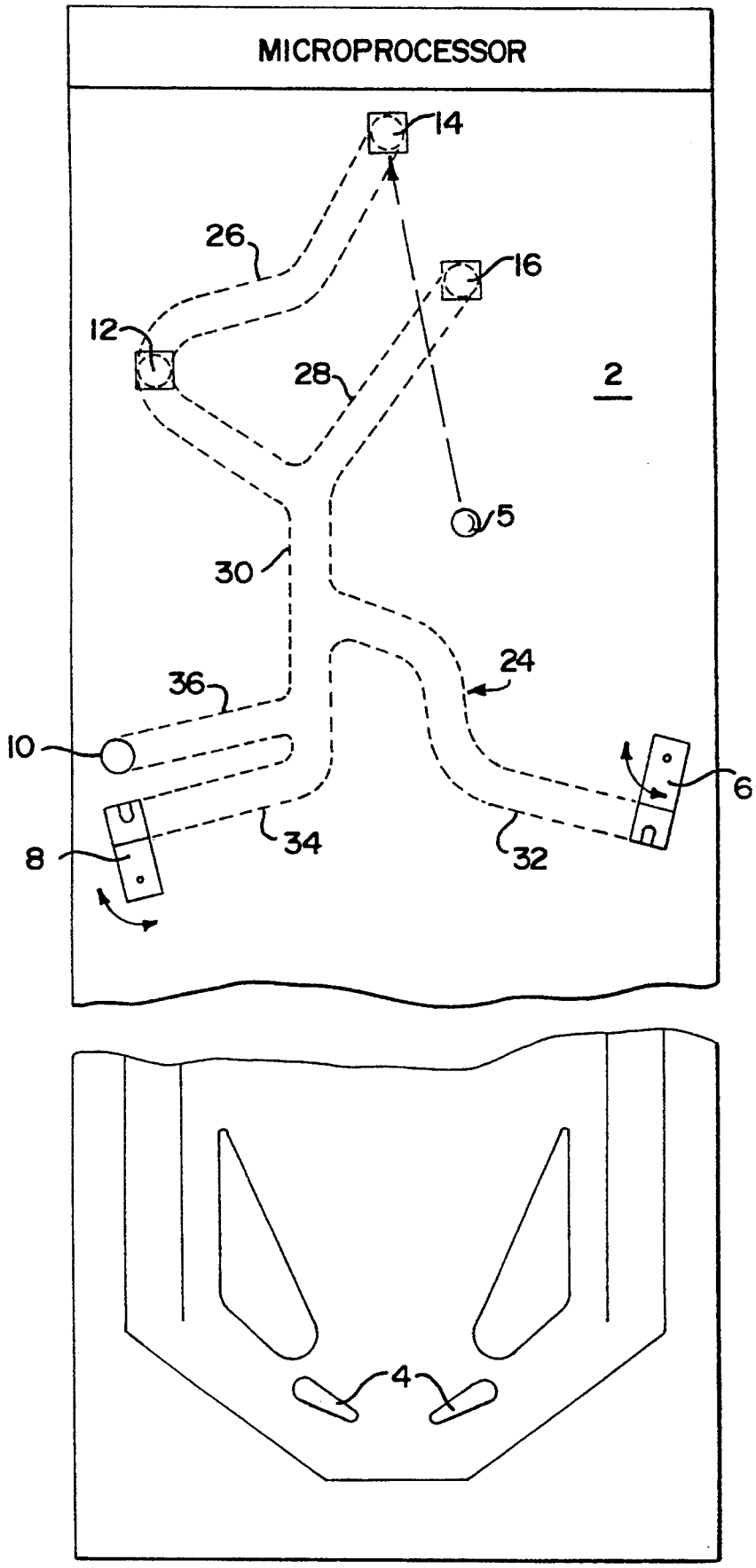
FIG. 1 is a top view of a playfield showing the ball delivery system in phantom line.

Referring more particularly to FIG. 1, a typical pinball game is illustrated having an inclined playfield 2 supporting player operated flippers 4 and a ball in play 5. The playfield 2 also supports, for example, a first ball cannon 6 and a second ball cannon 8 of the type disclosed in U.S. Pat. No. 5,186,462. The playfield also includes an eject hole 10. The ball cannons 6 and 8 and eject hole 10 are each located at a ball outlet of the below playfield ball delivery system as will hereinafter be described. Other play features such as ramps, bumpers, targets and the like (not shown) are supported on playfield 2 as will be appreciated. A microprocessor is used to control play of the game and operation of the ball delivery system of the invention.

Also located on playfield 2 are, for example, three ball inlets 12, 14 and 16 for delivering the ball in play 5 from the playfield to the below the playfield ball delivery system. Ball inlet 12 is shown in greater detail in FIG. 4, including a hole 15 in the playfield 2 having a ball guide 18 for guiding the ball into the hole 15. An optical switch 20 is provided for detecting the entrance of a ball into the ball inlet 12. It is to be understood that inlets 14 and 16 have structures similar to the structure of inlet 12 although arrangements of the inlets other than the illustrated structure can be used to deliver the ball to the ball delivery system.

Figure 2:
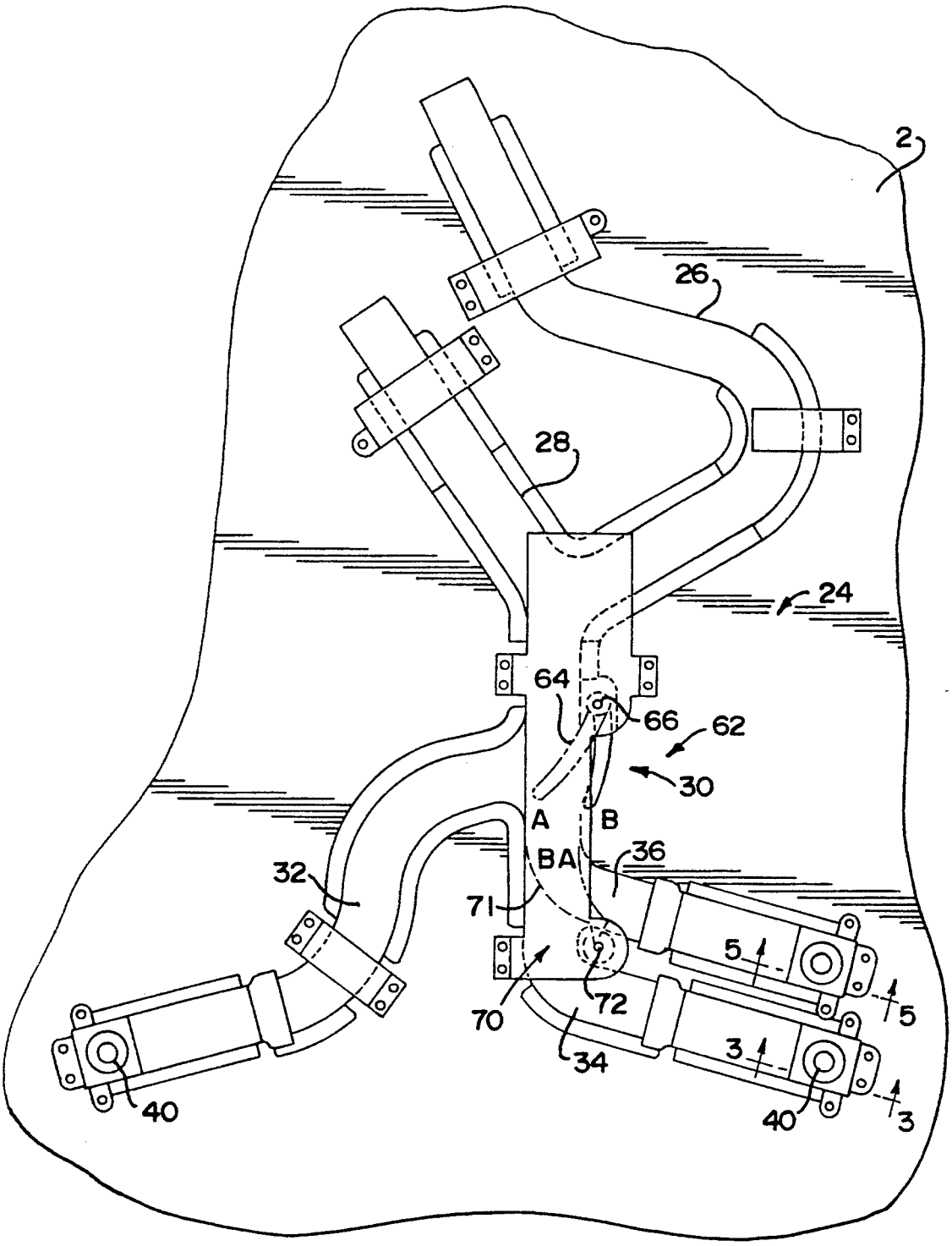
FIG. 2 is a bottom view of the playfield and ball delivery system of FIG. 1.

To convey the ball from the ball inlets 12, 14 and 16 to the ball cannons 6 and 8 and/or eject hole 10, a ramp 24 is located below the playfield 2 and is shown in FIGS. 1 and 2. In the preferred embodiment, the ramp 24 consists of a molded plastic, substantially U-shaped channels secured to the underside of the playfield. Because ramp 24 is secured to playfield 2, it is inclined relative to the horizontal at the same angle as the playfield such that a ball will roll from inlets 12, 14 and 16 to the play features 6, 8 and 10 by gravity.

The ramp 24 includes a first inlet section 26 that communicates with inlets 12 and 14 and a second inlet section 28 that communicates with inlet 16. While the invention is described with three inlets communicating with two ramp inlet sections, it is to be understood that a greater or fewer number of inlets could be used in combination with a greater or fewer number of ramp inlet sections. Moreover, the inlets could be located anywhere on the playfield where they can be accessed by a ball in play.

The ramp inlet sections communicate with a common ramp section 30 which, in turn, communicates with ramp outlet sections 32, 34 and 36. The ramp outlet sections 32, 34 and 36 terminate below the play features to be loaded such as ball cannons 6 and 8 and eject hole 10, respectively.

Referring to FIG. 3, the ball cannon 6, as described in detail in U.S. Pat. No. 5,186,462 is mounted on playfield 2 with ramp section 32 located adjacent thereto. An outlet hole 38 is located in playfield 2 adjacent cannon 6 and a solenoid activated kicker 40 is mounted below ramp section 32 vertically aligned with outlet hole 38. A ball 33 located at the end of ramp section 32 is positioned in an aperture 42 formed in the ramp such that when solenoid kicker 40 is actuated, plunger 44 will extend through aperture 42 to propel the ball through outlet hole 38 and into ball guide 46. Ball guide 46 directs the ejected ball to the ball cannon 6 where it can be fired onto the playfield. An optical switch 45 consisting of a light emitter and light detector (or other ball detector) is located adjacent aperture 42 to send a signal to the game microprocessor indicating the presence or absence of a ball in aperture 42. A similar arrangement is associated with ramp section 34 for loading ball cannon 8. It will be appreciated that a different mechanism can be used in place of kicker 40 to deliver the ball from ramp section 32 to cannon 6. Moreover, a play feature other than the illustrated ball cannon can be located above the ramp section to be loaded with a ball.

Referring more particularly to FIG. 5, eject hole 10 and ramp section 36 are illustrated. Eject hole 10 consists of an outlet hole 50 located in playfield 2 above aperture 52 formed in the end of ramp section 36. A solenoid kicker 51, such as that described above, is located below aperture 52 such that when kicker is energized plunger 54 will extend to propel ball 53 located in aperture 52 out hole 50. Other mechanisms for ejecting the ball can be used if desired. A deflector plate 56 is mounted on playfield 2 over hole 50 to deliver the ball horizontally onto playfield 2. An optical switch 58 consisting of a light emitter and detector (or other ball detector) is located adjacent aperture 52 to detect the presence or absence of a ball stored in aperture 52 and to deliver a signal to the game microprocessor.

To direct the ball from the ball inlets 18, 20 and 22 to a desired ball outlet, a pair of ball diverters are provided as shown in FIG. 2. The first ball diverter 62 consists of a gate 64 that extends through an aperture in side wall of ramp 24 and is pivoted to a pin 66 between positions A and B shown in FIG. 2. A solenoid or other driver is used to move the gate between the two positions. In position A, gate 64 will divert the ball from main ramp section 30 to ramp outlet section 32. In position B, balls will travel to sections 34 or 36.

A second ball diverter 70 is located at the end of main section 30 and consists of gate 71 pivotable about pin 72 between the positions A and B shown in FIG. 2. The gate 71 is pivoted by a solenoid or other suitable driver. In position A, the ball will be directed into outlet ramp section 34 and in position B the gate 71 will divert the ball into outlet ramp section 36. As will be appreciated, other arrangements of the ball diverters and ramp 24 can be used so that a ball rolling through the ramp can be directed from the inlets to a desired outlet.

Figure 6:
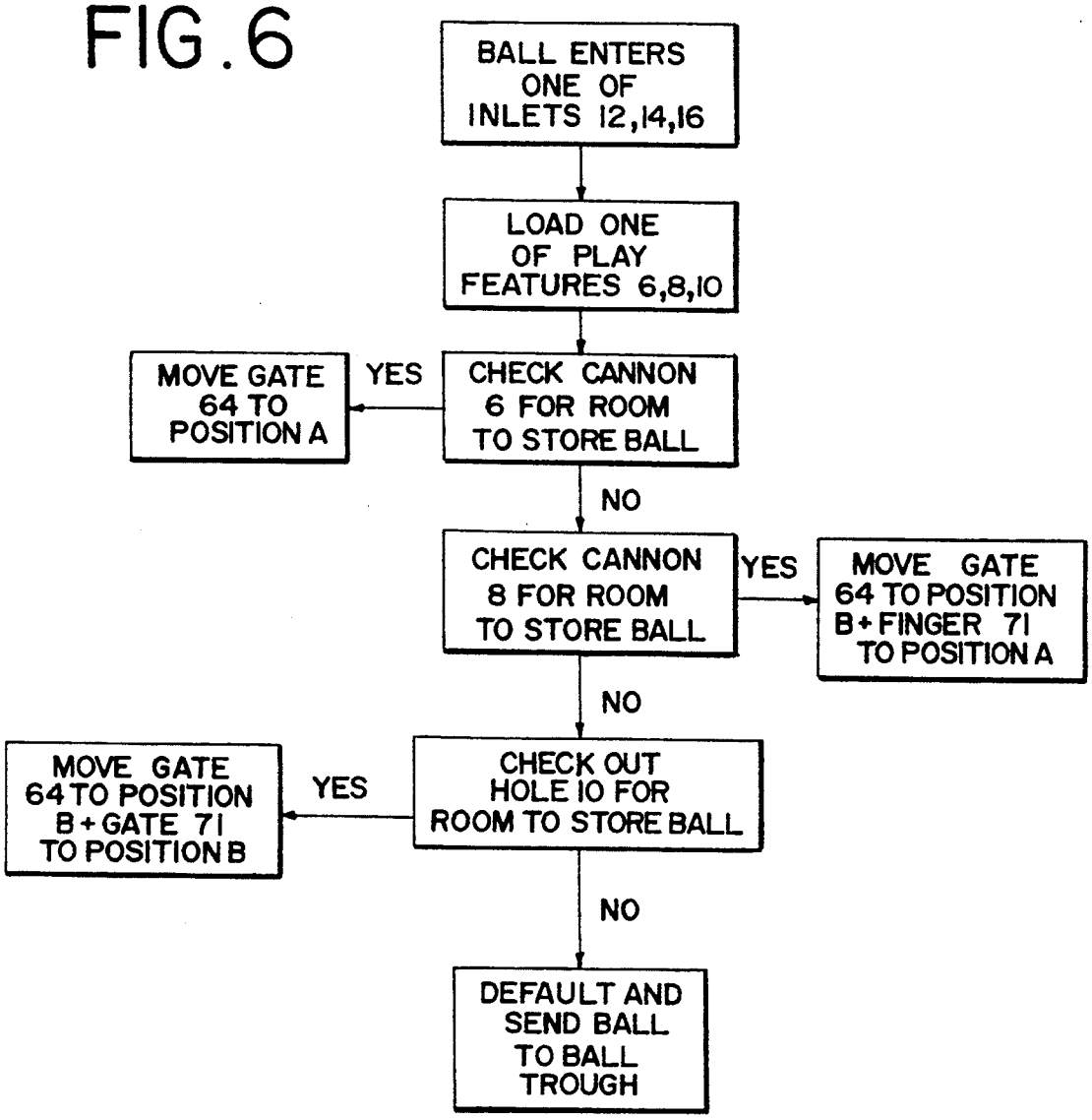
FIG. 6 is a flow chart showing the programming steps for the ball delivery system of the invention.

The operation of the ball diverter system will be described with specific reference to FIGS. 1 and 6. The game begins with at least one ball located in each outlet section as shown in FIGS. 3 and 5. While it is desired to have at least one ball in each outlet section, it is possible and desirable to have two balls at each outlet section. In such a situation, a first ball will be located over aperture and the second ball will be lined up behind the first ball as best shown in FIG. 5. A second optical switch 77 is provided to detect the presence or absence of the second ball and to deliver a signal to the microprocessor indicative thereof.

During the course of game play the player will be able to shoot or otherwise direct the ball in play into one of the ball inlets 12, 14 or 16 as determined by the game rules. When the ball enters one of the ball inlets, the optical switch 20 associated with that inlet will deliver a signal to the game microprocessor indicating that a ball has entered ramp 24. Upon receipt of this signal, the game microprocessor will immediately load a stored ball into one of the cannons 6 or 8 or will actuate the eject hole 10 such that play of the game continues virtually uninterrupted. The play feature activated by the microprocessor will depend on the game rules. For example, each of ball inlets 12, 14 and 16 can be associated with one of the play features 6, 8 and 10 such that when that inlet is accessed the associated play feature will be activated. Of course, the criteria for activating the particular play feature can vary and will be determined by the game program.

While the desired play feature is activated immediately using a stored ball, the ball that entered ramp 24 will roll down the ramp under the force of gravity. The game microprocessor will control the position of gates 64 and 71 to direct the ball to the desired ramp outlet section. The microprocessor first determines if any of switches 45, 58 or 77 are closed indicating that one of the outlet sections is without the desired number of balls. If the microprocessor receives such a signal the ball is directed to that ramp section. For example, assume that ball eject hole 10 (shown in FIG. 5) is activated such that the first ball 53 located in ramp section 36 is ejected into playfield 2 and also assume that two balls were located in that ramp section to begin play. Once ball 53 is ejected the second ball 57 will roll onto aperture 52 and switch 77 will signal the microprocessor indicating the absence of one of the stored balls. Accordingly, microprocessor will move gate 64 to position B and gate 71 to position B such that the ball will be conveyed from inlet 14 to ramp outlet section 36. If none of the optical switches indicate an open space the microprocessor can deliver the ball to anyone of the ramp sections by default or can deliver the ball to the game's ball trough associated with the shooter lane (not shown).

While the invention has been described in detail, it will be appreciated that numerous changes in the details and construction of the invention can be made without departing from the spirit and scope of the invention as set forth in the appended claim.

What is claimed is:

1. In a pinball game, having an inclined playfield supporting a rolling ball in play, a below the playfield ball delivery system comprising:

a) a ball inlet for receiving the ball in play from the playfield;

b) a ramp located below the playfield for delivering the ball in play from the ball inlet to a second location;

c) signaling means for detecting the entrance of the ball in play into said ball inlet;

d) means for storing at least one stored ball at said second location; and e) means for delivering said stored ball to said playfield upon detecting the ball in play entering said ball inlet.

2. The ball delivery system according to claim 1, wherein the ramp includes an extruded plastic channel secured to the underside of the playfield.

3. The ball delivery system according to claim 1, wherein the signaling means includes an optical sensor.

4. The ball delivery system according to claim 3, wherein the optical sensor includes a light emitter and light detector.

5. The ball delivery system according to claim 1, wherein said means for delivering said stored ball includes a kicker means for propelling the stored ball through an outlet hole in the playfield located above said second location.

6. The ball delivery system according to claim 5, wherein the kicker means extends through an aperture in the ramp to contact the stored ball.

7. The ball delivery system according to claim 5, wherein the kicker means loads the stored ball into a play feature disposed on the playfield.

8. The ball delivery system according to claim 7, wherein the play feature is a ball cannon.

9. The ball delivery system according to claim 1, further including a microprocessor operating in response to said signaling means to actuate said means for delivering.

10. In a pinball game having an inclined playfield supporting a ball in play, a below the playfield delivery system comprising:

(a) a plurality of ball inlets for receiving a ball in play from said playfield;

(b) a ramp located below the playfield for delivering the ball in play from any of the plurality of ball inlets to a plurality of storage locations spaced from the inlets;

(c) signaling means for detecting the entrance of the ball in play into one of said ball inlets;

(d) means for storing at least one stored ball at each of said storage locations;

(e) means for delivering at least one stored ball to said playfield upon detecting a ball in play entering one of said ball inlets; and (f) diverting means associated with said ramp for directing the ball in play to selected ones of said storage locations to maintain at least one ball at each storage location.

11. The ball delivery system according to claim 10, wherein each of the ball inlets is associated with an aperture in the playfield.

12. The ball delivery system according to claim 11, further including a microprocessor operating in response to said signaling means to actuate said means for delivery and to control said diverting means.

13. The ball delivery system according to claim 10, wherein the ramp includes a section associated with each of said plurality of ball inlets.

14. The ball delivery system according to claim 10, wherein the signaling means includes a switch associated with each of said ball inlets.

15. The ball delivery system according to claim 10, wherein the ramp includes an outlet section associated with each of said storage locations.

16. The ball delivery system according to claim 10, wherein said means for delivering said stored ball includes a kicker means for propelling the stored ball through an outlet hole in the playfield associated with said storage location.

17. The ball delivery system according to claim 16, wherein the kicker means extends through an aperture in the ramp to contact the stored ball.

18. The ball delivery system according to claim 16, wherein the kicker means loads the stored ball into a further play feature disposed on the playfield.

19. The ball delivery system according to claim 18, wherein the play feature is a ball cannon.

20. The ball delivery system according to claim 11, wherein said diverting means includes at least one movable gate for diverting the ball from the ball inlets to a desired one of the plurality of storage locations.

* * * * *